US008840093B2

(12) United States Patent
Won

(10) Patent No.: US 8,840,093 B2
(45) Date of Patent: Sep. 23, 2014

(54) NATURAL EVAPORATION HUMIDIFIER

(76) Inventor: Haion Won, Basking Ridge, NJ (US)

( * ) Notice: Subject to any disclaimer, the term of this patent is extended or adjusted under 35 U.S.C. 154(b) by 603 days.

(21) Appl. No.: 13/136,920

(22) Filed: Aug. 15, 2011

(65) Prior Publication Data

US 2013/0043605 A1 Feb. 21, 2013

(51) Int. Cl.

| | |
|---|---|
| ***B01D 47/00*** | (2006.01) |
| ***F24F 13/20*** | (2006.01) |
| ***F24F 6/04*** | (2006.01) |

(52) U.S. Cl.

CPC ..... *F24F 6/043* (2013.01); *F24F 13/20* (2013.01); *Y10S 261/41* (2013.01); *Y10S 261/65* (2013.01)

USPC .... 261/154; 261/101; 261/107; 261/DIG. 41; 261/DIG. 65

(58) Field of Classification Search

None

See application file for complete search history.

(56) References Cited

U.S. PATENT DOCUMENTS

| | | | | | |
|---|---|---|---|---|---|
| 1,894,898 | A | * | 1/1933 | Trane | 261/104 |
| 2,847,989 | A | * | 8/1958 | Powers et al. | 126/113 |
| 2,858,825 | A | * | 11/1958 | Skerritt | 126/113 |
| 5,624,610 | A | | 4/1997 | Yokoya | |
| 6,135,432 | A | * | 10/2000 | Hebblewhite et al. | 261/119.1 |
| 7,828,275 | B2 | | 11/2010 | Won | |
| 2008/0006953 | A1 | * | 1/2008 | Won | 261/154 |
| 2010/0258959 | A1 | | 10/2010 | Nakamura | |

* cited by examiner

*Primary Examiner* — Duane Smith
*Assistant Examiner* — Phillip Shao
(74) *Attorney, Agent, or Firm* — Song Law Firm LLC

(57) ABSTRACT

The present invention provides a natural evaporation humidifier which is space and energy efficient and maximizes humidification efficiency by enhancing diffusion of the moistened air. It is much easy and convenient for users to use, operate and carry the natural evaporation humidifier. The natural evaporation humidifier comprises a container, a plurality of inner support portions, a plurality of tunnels, a plurality of auxiliary support portions, a plurality of evaporation filters, and a plurality of support legs. The container, having a front and back wall, bottom, and side walls, forms an interior compartment and a water reservoir with the inner support portions. The inner support portions are shaped in curve, vertically attached to the bottom of the container, arranged in parallel along the length direction of the container to form a plurality of tunnels and evaporation filter housing areas. The inner support portions have a plurality of spacers inside each tunnel. Bulges are arranged at each end of both sides of the spacers. Evaporation filters are firmly fixed by the bulges and are in contact with water in the water reservoir of the container so that each evaporation filter becomes wetted through capillary action. Both the front and back walls of the container have a plurality of apertures on their upper region above the maximum water level of the water reservoir to facilitate enhanced diffusion of the moisture air as it exits the humidifier. Aqueduct slots are arranged to the bottom of the container to facilitate the movement of water from one side to other side of the container.

21 Claims, 9 Drawing Sheets

NATURAL EVAPORATION HUMIDIFIER

BACKGROUND OF THE INVENTION

1. Field of the Invention

The present invention relates to a natural evaporation humidifier having a water reservoir or a container, a plurality of filters, and a plurality of tunnels, naturally delivering moisture into the air in low humidity environments by using natural diffusion process of water molecule when the environment is at low humidity level.

2. Description of the Prior Art

Forced evaporation humidifiers powered by electricity, such as steam humidifier, impeller humidifier and ultrasonic humidifier, have been generally used in houses, offices and hospitals in order to increase humidity or moisture in a room and to achieve the desired humidity ranges. Most of the forced-evaporation humidifiers are operated by one of the following methods: 1) boiling water with electronic heating coils, releasing steam and moisture into the air; 2) using a device vibrating at an ultrasonic frequency, creating water droplets that silently exit a humidifier in the form of a cool fog; 3) using a rotating disc, flinging water at a diffuser, which breaks the water into fine droplets that float into the air; or 4) using a fan operated by a motor, blowing air onto a filter or wick to aid in the evaporation of water.

However, the forced evaporation humidifiers are often out of order, cause humming and other noises, and require relatively expensive maintenance, frequent inspections for cleanliness and parts condition and regular replacement of parts. These humidifiers further raise the relative humility to high levels and promote the growth of dust mites, bacteria and mold due to unnecessary use or overuse of them.

Owing to such disadvantages of the force evaporation humidifiers, natural evaporation humidifiers have become increasingly popular compared to the forced evaporation humidifiers. Natural evaporation humidifiers often make use of just a water reservoir and a filter or wick, which are usually non-commercial devices that can be assembled at little or no cost. Natural evaporation humidifiers usually work by the water in the reservoir spreading through the filter or wick by capillary action and naturally evaporating from wet filter or wick into the air in lower humidity environments. Natural evaporation humidifiers operate silently without moving parts such as fans powered by electricity, require very little maintenance and easily prevent the growth of bacteria and mold. Further, natural evaporation humidifiers do not need humidity control sensors in automatically equilibrating the humidity of a room with that of the wet filter or wick. However, such natural evaporation humidifiers have a disadvantage of decreasing of evaporation efficiency because the cool and humid air generated from evaporation from the filter or wick is unable to move downward to the floor due to the container of such natural humidifiers. Although some such natural humidifiers use a plurality of evaporation filters arranged in relation to each other in order to increase the evaporation areas, they are still incapable of increasing humidity because the cool and humid air is not allowed to move downward through the space between the evaporation filters and eventually becomes stagnant in the space.

In order to overcome the disadvantage of natural evaporation humidifiers, U.S. Pat. No. 7,828,275 to the inventor discloses a humidifier utilizing a plurality of evaporation filters in parallel arrangement so than air from an air source in a floor heating source passes thereover and also providing a plurality of tunnels between the evaporation filters, so that the tunnels facilitate flow of hot air from the heating source over each of the evaporation filters. The humidifier further provides a plurality of apertures, which are located above the water level of the water reservoir, on each of the front, back, and side walls of its container. These apertures facilitate enhanced diffusion of the moistened air as it exits the humidifier.

Although the humidifier of U.S. Pat. No. 7,828,275 has relatively succeeded in increasing humidity and evaporation efficiency, it has drawbacks in some respects. First, the length of its evaporation filters should be the same or less than the width of its container; thus, if the length of the filters increases for rapid and abundant evaporation, the width of container should increase as the same rate. Second, although the apertures on each of the front, back and side walls of the container assist in enhancing diffusion of the moistened air, all of the walls still obstruct the diffusion of the moistened air since the height of the walls is much higher than the height of support portions on which maximum water level of the water reservoir of the humidifier depends. Third, filing the water reservoir of the container with water is inconvenient and difficult because the space for filling water is relatively narrow and small or limited to the distance between each of the side walls and the support portions or the tunnels on the bottom of the container. Therefore, according to the humidifier, the space for filing water may expand only by decreasing the number and/or size of the support portions or the tunnels, which results in a decrease of the number of the evaporation filters. Fourth, it takes a long time to fully fill the water reservoir with water because the evaporation filters prevent water from directly passing through from one side to the other side. Last, the humidifier does not provide any useful part such as a handle in order for users to carry and place it easily and securely, especially when the water reservoir of the humidifier is fully filled with water.

Accordingly, there is a need in the art for a humidifier with a plurality of evaporation filters and tunnels that provides 1) larger length of evaporation filters than the width of its container without the need to enlarge the container, 2) the same or very similar height of walls of the container as the height of the support portions to enhance diffusion of the moistened air more effectively, and 3) useful part(s) in order for users to carry and place it easily and securely in any circumstance. In addition, there is a need in the art for a humidifier with a plurality of evaporation filters and tunnels that not only makes it easy and convenient for users to fill the water reservoir with water but also makes it very quick to fully fill the reservoir with water.

SUMMARY OF THE INVENTION

The present invention provides a natural evaporation humidifier, using a natural diffusion process of water molecule when the environment is at a low humidity level. To achieve efficient evaporation of moisture, a plurality of evaporation filters is housed inside the humidifier and air from an air source in a floor register is facilitated to traverse the tunnels provided between each evaporation filter. In the natural evaporation humidifier, a humidity control system is not required, as the humidifier automatically equalize the humidity level when the equilibrium between a plurality of evaporation filters and the environment is achieved.

A natural evaporation humidifier comprises a container, a plurality of inner support portions, a plurality of tunnels, a plurality of auxiliary support portions, a plurality of evaporation filters, and a plurality of support legs. The container comprises a front wall, back wall, bottom, and side walls (a left side wall and a right side wall), arranged to form an interior compartment and a water reservoir.

The side walls of the container are lower than both the front and back walls. The side walls are preferably about 6.0 to 9.0 cm high and both the front back walls are preferably about 7.0 to 10.0 cm higher than the side walls. The difference of height makes it more convenient for a user to supply water into the water reservoir of the humidifier from the side. The diffusion process of water molecules may be more rapidly facilitated by lowering the height of the side walls rather than the raising the height of side walls and using a plurality of apertures because the air from a heated air source easily and broadly contacts the evaporation filter through the open space above the side walls of the container without any obstacle.

The edges of the front, back and side walls of the container are curled outward, preferably in an upside down "U" shape to enhance the rigidity of the container and maintain the shape of the natural evaporation humidifier.

The container is slightly sloped to outward from the bottom so that the volume of the container is bigger than a rectangular shape, thus increasing the capacity of the water reservoir.

An inner support portion is vertically attached to the bottom of the container and a plurality of the inner support portions is arranged in parallel along the length of the container to form a plurality of tunnels and evaporation filter housing areas (correspondingly the spaces between the inner support portions) and to support a plurality of evaporation filters. The inner support portions are shaped in curves along the width of the container. The inner support portions have a plurality of spacers inside each tunnel and are the same height as the side walls. The leftmost of the inner support portions is attached to a point at least 10 cm away from the left side wall of the container in order to form the water reservoir big enough for users to fill with water easily and rapidly without it spilling out.

A plurality of tunnels is vertically extended from the bottom into the interior compartment of the container and arranged in parallel to the width direction of said container so that heated air enters the plurality of tunnels and contacts easily and rapidly with all of the evaporation filters.

A plurality of spacers is arranged inside each tunnel (correspondingly the inside space of each inner support portion) and in parallel to the length of the container to support each inner support portion and to keep evaporation filter housing areas in constant size and shape so that each evaporation filter is firmly placed into each evaporation filter housing area. One of said spacers is located in the middle of each tunnel. Preferably, three spacers are arranged inside each said tunnel and located in the middle and two sides of each tunnel (correspondingly the inside space of each inner support portion).

A plurality of bulges is outwardly extruded to a normal direction from the surface of the inner support portion and appointed to receive the evaporation filter, minimizing the contact area between the evaporation filter and the inner support portion. Each such bulge is arranged at each end of both sides of each spacer. The bulges form a rounded shape and the distance between the bulges facing each other is preferably about 1.0 mm to 2.5 mm longer than the thickness of the evaporation filters.

A plurality of auxiliary support portions is vertically attached to the bottom of the container and extended to the interior compartment at the end of both sides of the inner support portions, and run parallel with the inner support portions so that the auxiliary support portions are arranged on the curved line that has the same shape as the inner support portions. Each of the auxiliary support portions has the upper horizontal line of a "T" curved and inwardly directed to the inner support portions. Each of the auxiliary support portions faces to each of the bulges, facing to either the right side wall or the left side wall, of both the leftmost and rightmost ones of the inner support portions and there is a space with constant distance between each auxiliary support portion and each s bulge in order to firmly hold both the first and last one of the evaporation filters at each end of both sides of the inner support portions. The distance between each auxiliary support portion and each bulge facing each other is the same as the distance between the bulges facing each other, which is preferably about 1.0 mm to 2.5 mm longer than the thickness of the evaporation filter. The auxiliary support portions are lower than the inner support portions and further have a height ranging from 4.5 to 6.0 cm.

A plurality of evaporation filters is placed and fixed in the evaporation filter housing areas and in the space between the auxiliary support portions and the bulges, and each evaporation filter is firmly fixed by the bulges and in contact with water in the water reservoir of the container so that each of the evaporation filter becomes wetted. The length of the evaporation filters may be longer than the width of the container. The height of the evaporation filters may be about twice higher than that of the inner support portions. Each evaporation filter includes a positioning slot located in the middle of the bottom of the evaporation filter. The evaporation filter may be in rectangular shape with bottom corner chamfered to facilitate the movement of supplying water. The evaporation filter is composed of thermally compressed non-woven polypropylene or polyethylene plastic materials.

Both the front back wall of the container include a plurality of apertures on their upper region above the height of the side walls which is the same as the height of the maximum water level reserved in the container. The upper region of each of the front and back walls preferably has three apertures, one in the middle and the other two on both sides of each wall, and each of the three apertures is at least 5.5 cm in height and at least 6.5 cm in length, and further wherein the distance between said three apertures on each wall is about 1.0 to 2.0 cm and the three apertures are located about 1.0 to 2.5 cm inwardly away from the top and both sides of each wall. The apertures facilitate enhanced diffusion of the moistened air as it exits the humidifier. In addition, upper region of the aperture may be used as a handle bar to carry the humidifier when moving the humidifier from one place to another A plurality of aqueduct slots is arranged to the bottom of the container between the inner support portions and each of the front and back walls, in parallel to the length of the container, in order to facilitate the movement of water from one side to other side of the container, to decrease the time to supply water into such humidifier, and to make all of the evaporation filters absorb moisture more quickly.

A filter positioner is vertically extruded from the bottom of the container and is arranged in the middle of each evaporation filter housing area between the inner support portions as well as in the middle of a space between the inner support portion and the auxiliary support portions, and is aligned with the spacer attached in the middle of the tunnel to securely hold the evaporation filter. The filter positioner preferably has a height ranging from 1.8 cm to 2.5 cm.

The natural evaporation humidifier includes at least four support legs outwardly extruded from the bottom of the container to provide the stability and durability of the humidifier and to further provide a vertical clearance between the floor register and the bottom of container so that the air from the heat air source easily and efficiently traverses into the tunnels through the vertical clearance. The height of the support legs may be larger than the depth of the aqueduct slots.

With the simplicity of the structure, the humidifier has many advantageous features. The cost of operation is minimal because the humidifier has no mechanically moving parts; thus, it does not consume any electricity. Also, the humidifier is formed in an uni-body shape using plastic material, so its retail price is attractively low and it is easy to carry. It is easy to clean the humidifier using washing by hand or using a dishwasher with detergent. As a result, the humidifier can prevent the growth of any bacterial or mold. Unlike conventional humidifiers, the humidifier does not cause its surrounding areas or its outer surface to be wet.

Further, in order to maximize humidification efficiency by enhancing diffusion of the moistened air, the natural evaporation humidifier provides a greater length of evaporation filters than the width of its container without the need to enlarge the container, and the same height of side walls of the container as the height of the inner support portions. The humidifier also provides a kind of handle through the apertures on the upper region of the front and back walls in order for users to carry and place it easily and securely in any circumstance. In addition, the humidifier makes it easy and convenient for users to fill the water reservoir with water without spilling it, and requires only a short time to fully fill the reservoir with water.

BRIEF DESCRIPTION OF THE DRAWING

The invention is more easily understood when the following detailed description of the preferred embodiments of the invention and the accompanying drawings are explained.

DETAILED DESCRIPTION OF THE INVENTION

The present invention provides a natural evaporation humidifier naturally delivering moisture into the air in low humidity environments by using a natural diffusion process of water molecule when the environment is at low humidity level. To achieve efficient evaporation of moisture, a plurality of evaporation filters are housed inside the humidifier and air from an air source in a floor register is facilitated to traverse the tunnels provided between each evaporation filter. The natural evaporation humidifier does not require any moving parts necessitating the use of electricity or the maintenance of the mechanical parts, thus reducing the cost of operation. The evaporation is naturally occurred with no use of artificial air flow by a fan, enabling quiet operation of the device. In addition, a humidity control system is not required, as the humidifier automatically equalizes the humidity level when the equilibrium between a plurality of evaporation filters and environment is achieved.

Figure 1:
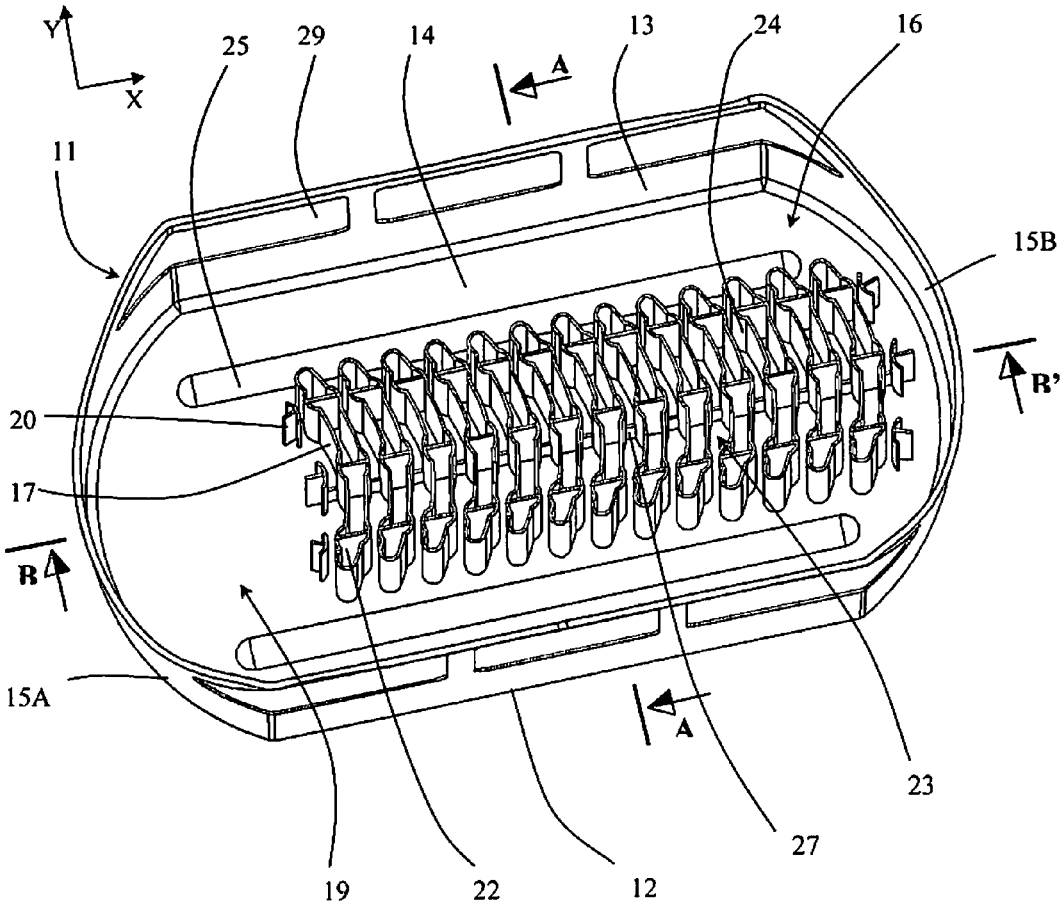
FIG. 1 illustrates a front view of an embodiment of the natural evaporation humidifier for use with a source of heated air, with the device being placed on a floor register.

FIG. 1 illustrates a front view of an embodiment of the natural evaporation humidifier 10 for use with a source of heated air, preferably, the device being placed on a floor register. The natural evaporation humidifier 10 comprises a container 11, a plurality of inner support portions 17, a plurality of tunnels 18, a plurality of auxiliary support portions 20, a plurality of evaporation filters 21, and a plurality of support legs 26. The container 11 comprises a front wall 12, back wall 13, bottom 14, and side walls 15 (a left side wall 15A and a right side wall 15B), arranged to form an interior compartment 16 and a water reservoir 19. The side walls 15 of the container 11 are preferably outwardly curved or rounded. The side walls 15 are preferably about 6.0 to 9.0 cm high. The front and back walls 12 and 13 are higher than the side walls 15, preferably 7.0 to 10.0 cm higher. The upper region of the front and back walls 12 and 13 above the height of the side walls 15 is preferably in rounded trapezoid shape.

An inner support portion 17 is vertically attached to the bottom 14 of the container 11 and the plurality of the same is arranged in parallel along the length of the container 11, x-direction in FIG. 1, to form a plurality of tunnels and evaporation filter housing areas 18 and to support the evaporation filters 21 in the same parallel arrangement. The inner support portions 17 are arranged within container 11 to form a water reservoir 19 appointed to receive and house water. The inner support portions 17 are shaped in curve, more closely the shape of crescent, along the width of the container 11, y-direction in FIG. 1. The inner support portions 17 are at the same height as the side walls 15, so that they are preferably about 6.0 to 9.0 cm high. The leftmost one of the inner support portions 17 is attached to the point of at least 10 cm away from the left side wall 15A of the container 11 in order to form space big enough for users to fill the water reservoir with water easily and rapidly without it spilling out.

The plurality of tunnels 18 is arranged in parallel along the length of the container 11, x-direction in FIG. 1 and extend from the bottom 14 into the interior compartment 16 of the container 11 so that heated air from a source enters the plurality of tunnels 18, traverses into the interior compartment 16 of the container 11, and contacts easily and rapidly with all of the evaporation filters 21. Because of the relation between the inner support portions 17 and the tunnels 18, the tunnels 18 have the same shape that the inner support portions 17 have.

An auxiliary support portion 20 is vertically attached to bottom 14 of the container 11 and extended to the interior compartment 16 at the end of both sides of the inner support portions 17 to house two evaporation filters 21 located at the end of both sides. The auxiliary support portion 20 may preferably be "T" shaped and positioned with three of them on each side for a total of six. The "T" shaped auxiliary support portions 20 may preferably have the upper horizontal line of a "T" curved or rounded which faces the inner support portions 17. Auxiliary support portions 20 run parallel with inner support portions 17 so that three auxiliary support portions 20 at each end of the inner support portions 17 are arranged on a curved line which has the same shape as the inner support portions 17. One of the three auxiliary support portions 20 on each side is placed in the middle of such curved line and is connected to a filter positioned 27, which is located on the same line as both the middle spacer 22 in the inside space of each inner support portion 17 and a filter positioner 27 of the evaporation filter housing area 23 between inner support portions 17. Six auxiliary support portions 20 and six outside bulges 24, facing to the side walls 15, of both the leftmost and rightmost inner support portions 17 are facing each other and there is a space with constant distance between the auxiliary support portions and the bulges in order to hold both the first and last evaporation filters at each end of both sides of the inner support portions. All auxiliary support portions have the same height and are at least 4.0 cm high from the bottom 14 of the container 11. Preferably, the auxiliary support portions are about 4.5 to 7.5 cm high.

Each of the evaporation filters 21 is placed and fixed in each of evaporation filter housing areas 23 (correspondingly the space between inner support portions 17) and in the space between the auxiliary support portions and said bulges. The evaporation filters 21 absorb the water filled in the water reservoir 19 and then evaporate into the air at low humidity level. The length of the evaporation filters may be longer than the width of the container because the evaporation filters are placed in such curved shape as inner support portions 17. The height of the evaporation filters 21 is higher than that of the inner support portions 17, preferably about twice higher than that of the inner support portions 17, so that the upper portion of the evaporation filters above the height of the inner support portions 17 easily and broadly contacts with the air from a hearted air source and promotes rapid evaporation. The evaporation filters 21 are at least 1.5 mm thick, preferably about 1.6 to 2.5 mm thick.

A plurality of spacers 22 is arranged inside each tunnel 18 (correspondingly the inside space of each said inner support portion 17) and in parallel to the length of the container 11. One of the spacers is located in the middle of each tunnel. The spacers 22 maintain the constant size and shape of each inner support portion 17 during the manufacturing process, preferably an extrusion process, preventing any distortion of the inner support portion 17 due to the thermal change of raw materials while cooling down. Due to the spacer 22, a plurality of evaporation filter housing areas 23 (correspondingly the spaces between inner support portions 17 in this embodiment) are constantly arranged, and each evaporation filter housing area 23 keeps a constant size and shape so that each evaporation filter 21 can be firmly placed into each evaporation filter housing area 23. Preferably, three spacers 22 are located in the middle and two sides of the inside space of each inner support portion 17.

A bulge 24 having a rounded shape is arranged at each end of both sides of each spacer 22. The bulge 24 vertically forms the shape on the surface of inner support portion 17, being outwardly extruded to a normal direction from the surface of inner support portion 17. Three of spacers 22 are applied to each inner support portion 17 in this embodiment, thus total of six bulges 24 are possibly arranged. The bulge 24 is appointed to receive the evaporation filter 21 when the same is located in evaporation filter housing area 23. To minimize the contact area, the evaporation filter 21 and bulge 24 are appointed to be a line contact. The effect of minimal contact between the evaporation filter 21 and bulge 24 relatively maximizes the contact area of the evaporation filter 21 with air, which causes rapid evaporation and eventually enhances humidification efficiency of the natural evaporation humidifier 10. The evaporation filter 21 contacts at least three bulges 24 out of six and continues to be held firmly during the humidifying operation. The distance between the bulges 24 facing each other is preferably about 1.0 to 2.5 mm longer than the thickness of the evaporation filter 21.

Continuing with FIG. 1, a plurality of aqueduct slots 25 is arranged to the bottom 14 of the container 11 between the inner support portions 17 and each of the front and back walls 12 and 13, forming along the direction of length, x-direction in FIG. 1. When water is supplied from one side of the container 11, the aqueduct slots 25 facilitate the movement of water from one side to the other side of the container 11, decrease the time to supply water into such humidifier 10, and make all of the evaporation filters 21 absorb moisture more quickly and become wet through capillary action. The aqueduct slots 25 are long enough to pass right under all of the evaporation filters 21 placed into the evaporation filter housing areas 23. Forming the aqueduct slots 25 on the bottom 14 of the container 11 improves the rigidity of the bottom 14 of the container 11 and, therefore, enables the thickness of the bottom 14 of the container 11 at the same level of material strength to be reduced. The production cost is reduced accordingly with the less use of material and the light weight of the product is expected.

Figure 2:
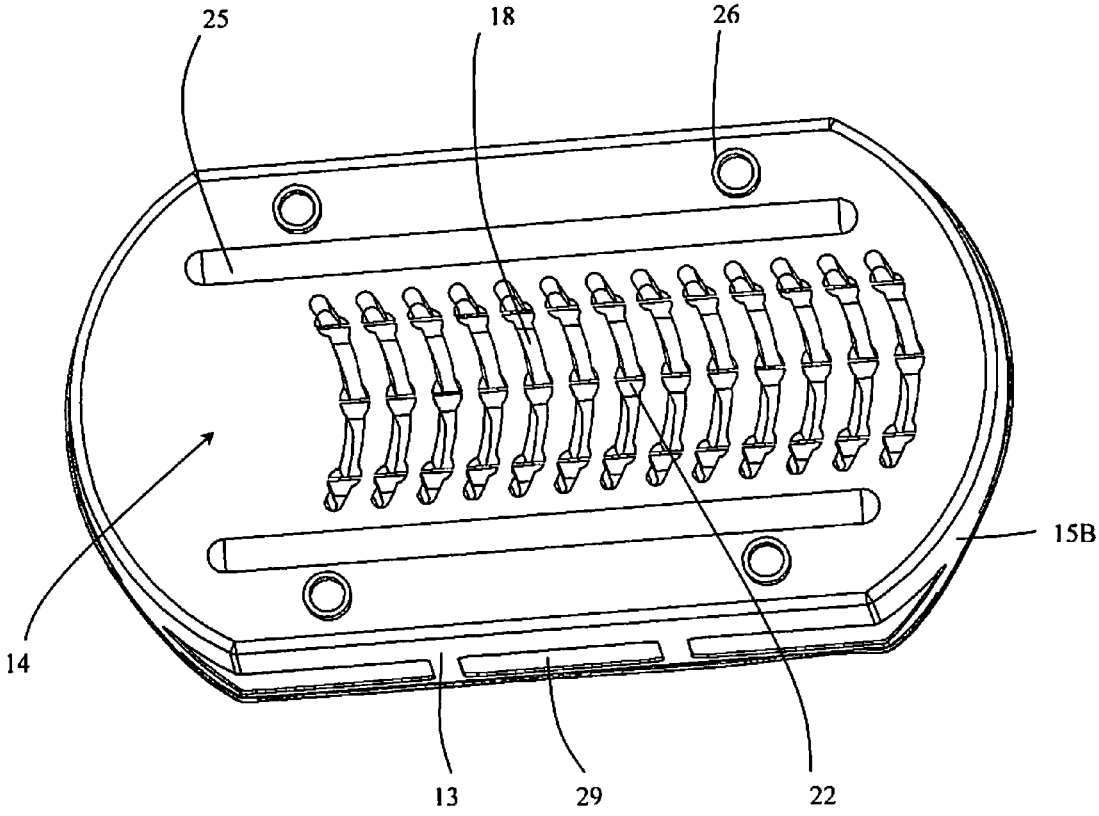
FIG. 2 illustrates a bottom view of the natural evaporation humidifier embodiment illustrated in FIG. 1.

FIG. 2 illustrates a bottom view of the natural evaporation humidifier 10 embodiment illustrated in FIG. 1. The natural evaporation humidifier 10 includes at least four support legs 26 outwardly extruded from the bottom 14 of container 11. The support legs 26 are designed to provide stability to such humidifier 10 and may have either six or eight legs to enhance the durability and stability of such humidifier 10. The support legs 26 are spaced apart from one another and appointed to provide a vertical clearance between the floor register and the bottom 14 of the container 11 so that the air from the hot air source easily and efficiently traverses into the tunnels 18 through the vertical clearance. In addition, the height of the support legs 26 may be larger than the depth of the aqueduct slots 25 in order for the aqueduct slots 25 not to prevent the air from passing into the vertical clearance in the width of the container, y-direction in FIG. 1.

In operation, water is supplied to container 11 of the humidifier 10 and the bottom 14 of the container 11 with the tunnels 18 of the inner support portions 17 located in close proximity to the source of heated air. Heated air flows into the tunnels 18 and passes through the surface area of the evaporation filters 21 which were made wet through the capillary action of water. Moisture from the evaporation filters 21 evaporates into the heated air as the heated air traverses the wetted evaporation filters 21. Heated air becomes humidified and the humidified air is diffused into the environment. When the humidity level of the environment is low, the evaporation process becomes more active.

Figure 3:
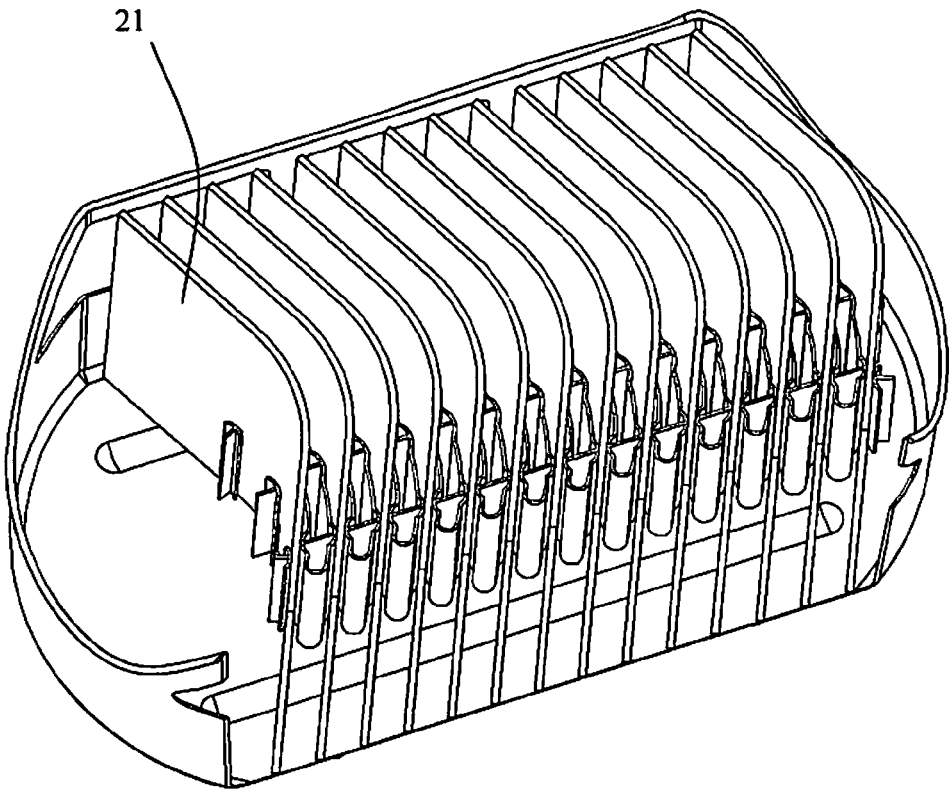
FIG. 3 illustrates a front view of the natural evaporation humidifier embodiment illustrated in FIG. 1, wherein a plurality of evaporation filters reside in the container.

FIG. 3 illustrates a front view of the natural evaporation humidifier 10 embodiment illustrated in FIG. 1, wherein a plurality of evaporation filters 21 resides in the container 11. Inner support portion 17 is shaped in a curve, more closely the shape of a crescent, along the width of the container 11, y-direction in FIG. 1. As such, the evaporation filter 21 appointed to reside at evaporation filter housing area 23 is curved in the identical shape of inner support portion 17 along the width of the container 11, y-direction in FIG. 1. Since the arc length (the length of the curved line) is longer than the straight line distance between its endpoints, the length of the evaporation filter 21 in such curved shape can be longer than that of an evaporation filter 21 in linearly straight shape, in the same size of the container 11, so that the longer length size of the evaporation filter 21 can be placed in the humidifier 10. In other words, the evaporation filter 21 housed in a curved shape has a greater surface area than straight shaped filter. As a result, it increases the efficiency of the evaporation process at the surface area of the curved-shape evaporation filter 21.

Figure 4:
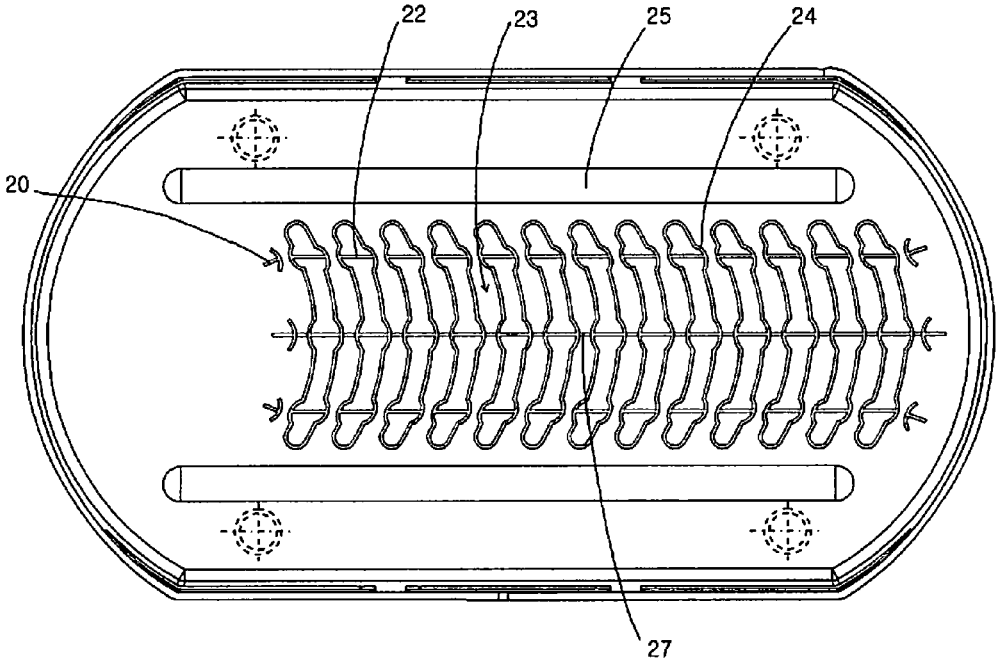
FIG. 4 illustrates a top view of the natural evaporation humidifier embodiment illustrated in FIG. 1.

FIG. 4 illustrates a top view of the natural evaporation humidifier 10 embodiment illustrated in FIG. 1. In FIG. 4, a filter positioner 27 is arranged in the middle of evaporation filter housing area 23 between inner support portions 17, being aligned with the spacer 22 attached in the middle of the tunnel 18. The filter positioner 27 is installed in order to securely hold the evaporation filter 23, forming a certain height from the bottom 14 of container 11, preferably having a height ranging from 1.8 cm to 2.5 cm. To accommodate the evaporation filter 23 to be inserted to the filter positioner 27, a positioning slot 28 is formed in the middle of the bottom of the evaporation filter 23 by which the evaporation filter 23 is vertically cut the same height from its middle of the bottom as the filter positioner 27. The filter positioner 27 holds the position of the evaporation filter 23 so it will not move sideways or fall off during humidifying operations or moving. In addition, when the humidifier 10 is put in a dishwashing appliance to be cleaned, the filter positioner 27 keeps the evaporation filter 23 from being taken out of the humidifier 10.

Figure 5A:
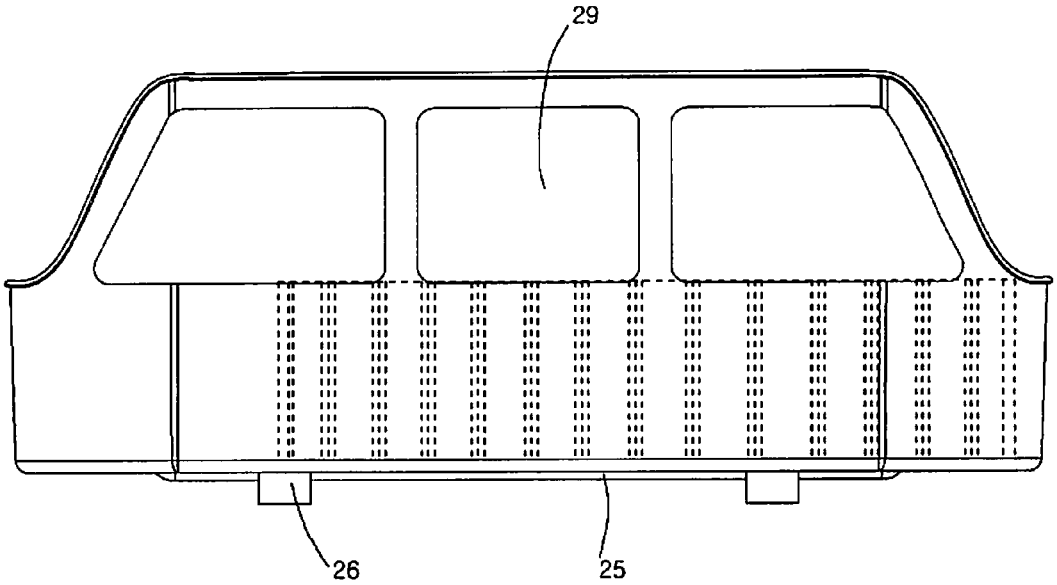
FIGS. 5*a* and 5*b* illustrate a front view and side view of the natural evaporation humidifier embodiment illustrated in FIG. 1, respectively.
Figure 5B:
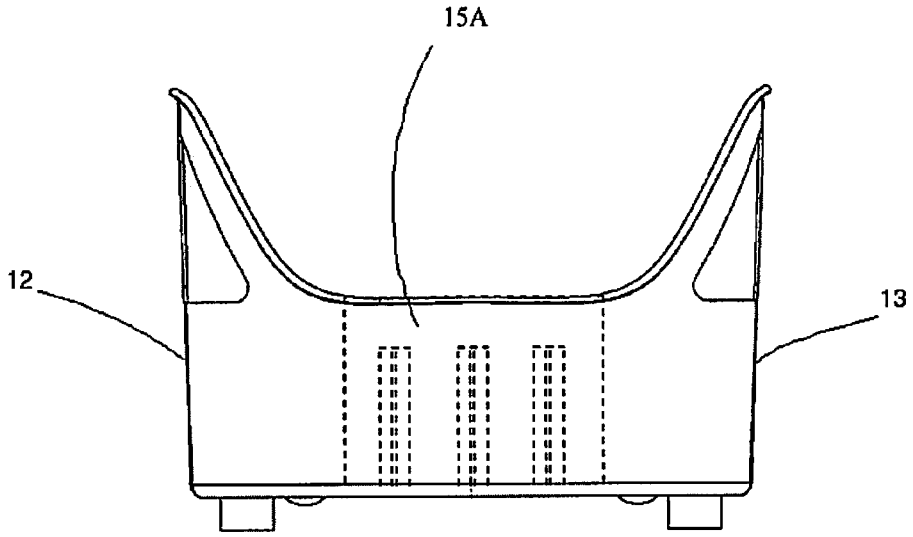

FIGS. 5*a* and 5*b* illustrate a front view and side view of the humidifier 10 embodiment illustrate in FIG. 1, respectively, wherein the front and back walls 12 and 13 of container 11 may further include a plurality of apertures 29 located therein. These apertures 29 are located on the upper region of the front and back walls 12 and 13 above the height of the side walls 15 which is the same as the height of the maximum water level reserved in the container 11 to prevent leakage of the water from the humidifier 10. Preferably, three apertures 29 are located on the upper region of each of the front and back walls 12 and 13 one in the middle and the rest two on both sides of each such wall. The apertures are at least 5.5 cm in height and at least 6.5 cm in length. The distance between the apertures 29 on each of such walls 12 and 13 is preferably about 1.0 to 2.0 cm. The apertures 29 are located about 1.0 to 2.5 cm inwardly away from the top and both sides of each of such walls 12 and 13. The shape of apertures 29 may include, but is not limited to, square, rectangular, trapezoid, and oval shapes. The middle aperture 29 is preferably square with rounded corners, and the side apertures 29 are preferably trapezoids with rounded corners, dependent on the shape of the upper region of the front and back walls 12 and 13. These apertures, which are relatively big, reduce the weight of the humidifier 10, which reduces the cost of manufacturing it. These apertures also facilitate enhanced diffusion of the moistened air as it exits the humidifier 10. In addition, the upper region of the aperture 29 may be used as a handle bar to carry the humidifier 10 when moving it from one place to another.

The front wall 12, back wall 13 and side walls 15 of the container 11 are slightly sloped to outward from the bottom 14 of the container 11. This slope allows the humidifier 10 to be removed easily from the dice during the extrusion manufacturing process. Also, the humidifiers 10 at the manufacturing site are possibly stored in the warehouse occupying minimal space by stacking up on one another. The volume of the container 11 is bigger than that of a container in a rectangular cuboid shape thus, increasing the capacity of the water reservoir of the container 11.

The humidifier 10 may be composed of a polymeric or plastic material. The upper region of the front wall 12, and back wall 13 and side walls 15 of the container 11 are curled outward, preferably in an upside down "U" shape, enhancing the rigidity of the container 11 and maintaining the shape of the humidifier 10.

Continuing with FIG. 5*a*, the height of the side walls 15 of the container 11 is lower than that of both the front wall 12 and the back wall 13 of the container 11, illustrated in FIG. 5*b*. The difference of height makes it more convenient for users to supply water into the water reservoir 19 of humidifier 10 from the side. The diffusion process of water molecules may be more rapidly facilitated by lowering the height of the side walls 15 rather than the raising the height of side walls 15 and using a plurality of apertures 29 because the air from a heated air source easily and broadly contacts the evaporation filter 21 through the open space above the side walls 15 of the container 11 without any obstacle.

Figure 6A:
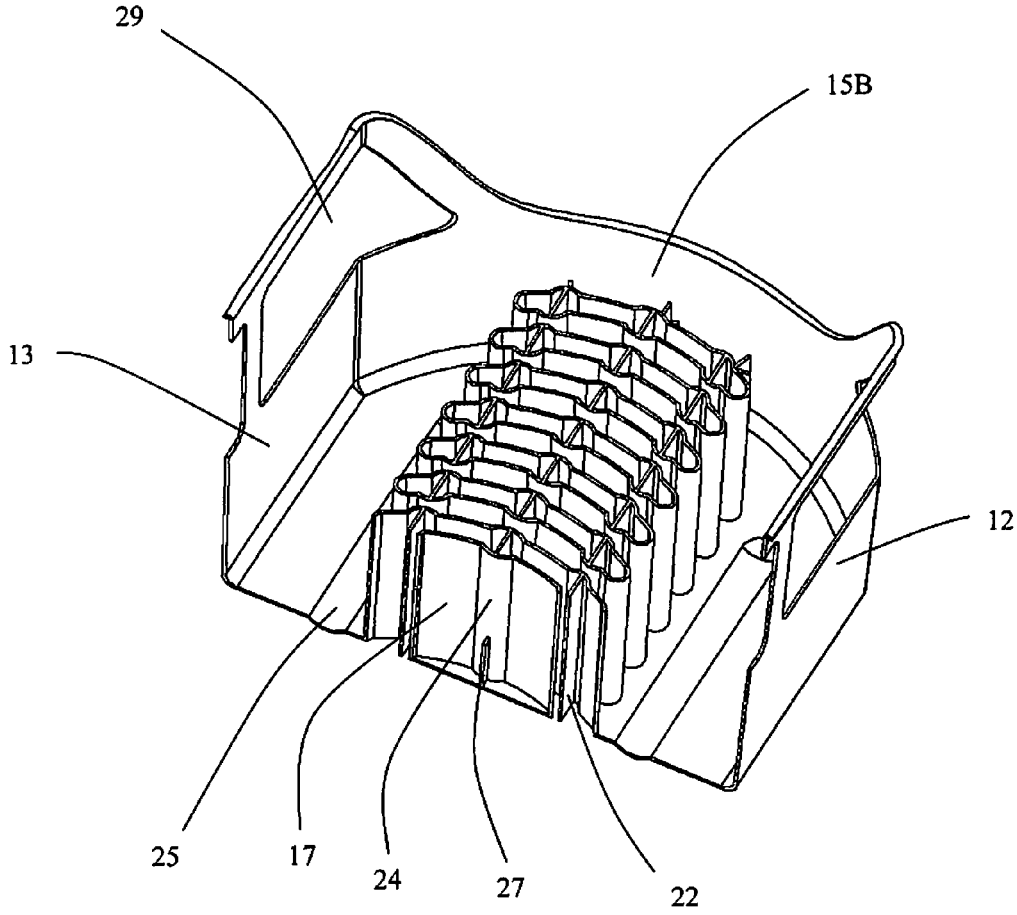
FIGS. 6*a* and 6*b* illustrate a cut-away front view of the natural evaporation humidifier embodiment illustrate in FIG. 1, wherein the container is severed to further show the inner support portion in the direction of AA' and in the direction of BB', respectively. The direction of AA' and BB' are described in FIG. 1.
Figure 6B:
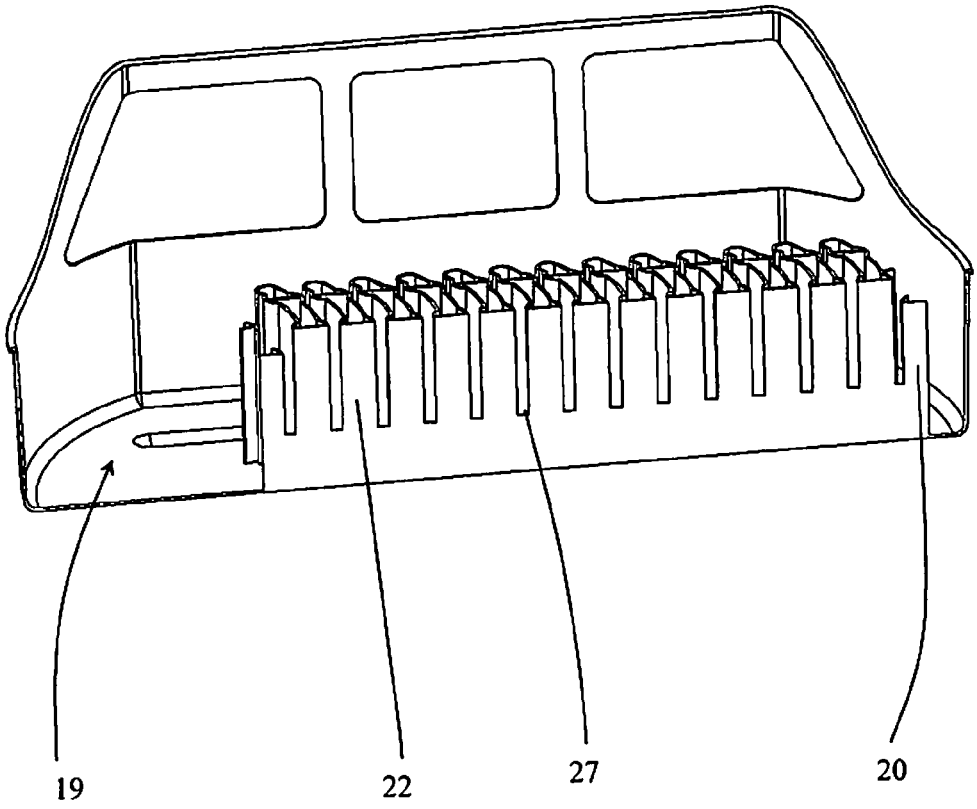

FIGS. 6*a* and 6*b* illustrate a cut-away front view of the humidifier 10 embodiment illustrate in FIG. 1, wherein the container 11 is severed to further show the inner support portion 17 in the direction of AA' and in the direction of BB', respectively. The direction of AA' and BB' are described in FIG. 1. In FIG. 6*a*, the plurality of spacers 22 are arranged inside the inner support portion 17 appointed to be aligned to the direction of length, x-direction in FIG. 1. The shape of inner support portion 17 is clearly shown as curved, more preferably in the shape of crescent. FIG. 6*b* illustrates the existence of filter positioner 27 located between the inner support portions 17. The height of filter positioner 27 is lower than that of inner support portion 17 so that the evaporation filter 21 can be easily inserted on the filter positioner 27.

Figure 7A:
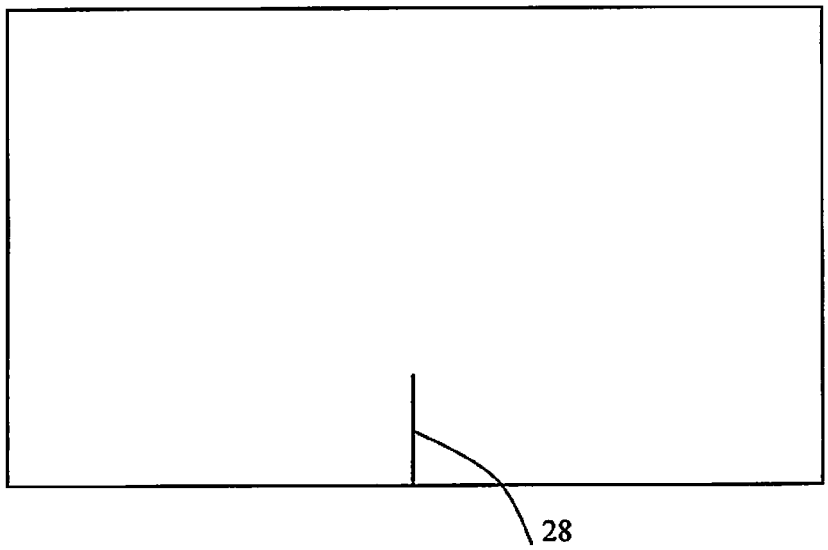
FIGS. 7*a* and 7*b* illustrate a front view of an evaporation filter, representing possible embodiments respectively.
Figure 7B:
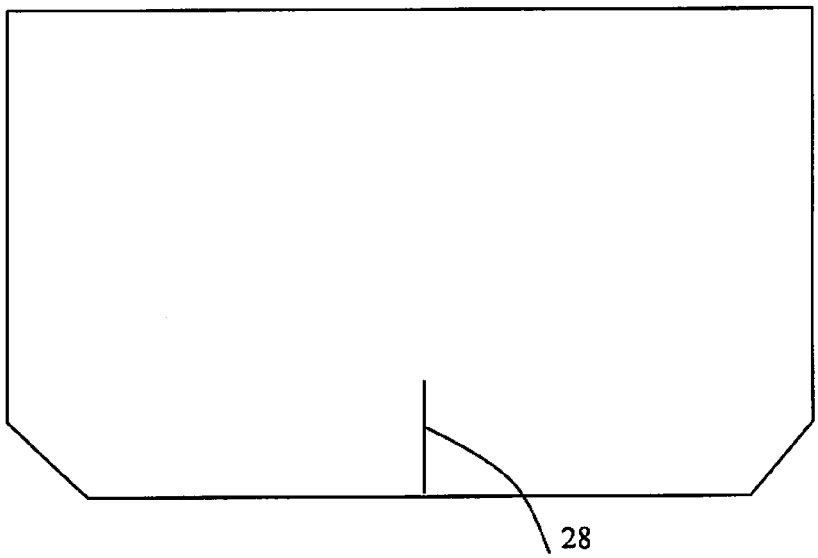

The evaporation filter 21 may be composed of thermally compressed non-woven polypropylene or polyethylene plastic materials. The durability of plastics is good enough to use without the need of replacement. Also, the evaporation filter 21 is easily and safely cleaned without its deformation even when the evaporation filter 21 is washed in either a washing machine or a dishwasher with a conventional detergent. FIGS. 7*a* and 7*b* illustrate a front view of an evaporation filter 21, representing possible embodiments respectively. The evaporation filter 21 is in a rectangular shape in FIG. 7*a*, or with bottom corners chamfered in FIG. 7*b*. The purpose of chamfering in FIG. 7*b* is to facilitate the movement of supplying water even when the aqueduct slots 25 are not installed on the bottom 14 of container 11. The positioning slot 28 is located in the middle of the bottom of the evaporation filter, shown both in FIGS. 7*a* and 7*b*.

With the simplicity of the structure, the humidifier 10 described here has many advantageous features. The cost of operation is minimal because the humidifier 10 has no mechanically moving parts; thus, it does not consume any electricity. Also, the humidifier 10 is formed in an uni-body shape using plastic material, so its retail price is attractively low and it is easy to carry. It is easy to clean the humidifier 10 using washing by hand or using a dishwasher with detergent. As a result, the humidifier 10 can prevent the growth of any bacterial or mold. Unlike conventional humidifiers, the humidifier 10 does not cause its surrounding areas or its outer surface to be wet. Further, the humidifier 10 automatically control and maintain the humidity in a room at comfortable levels between 30 to 55 percent for the human body. Since the humidifier 10 is made out of either a polymeric or plastic material, its weight and size can be reduced and also it is easy for users to carry and operate it.

Moreover, in order to maximize humidification efficiency by enhancing diffusion of the moistened air, the humidifier 10 provides a greater length of the evaporation filters 21 than the width of the container 11 without the need to enlarge the container 11, and the same height of side walls 15 of the container 11 as the height of the inner support portions 17. The humidifier 10 also provides a kind of handle through the apertures 29 on the upper region of the front and back walls 12 and 13 in order for users to carry and place it easily and securely in any circumstance. In addition, the humidifier 10 makes it easy and convenient for users to fill the water reservoir 19 with water without spilling it, and requires only a short time to fully fill the reservoir 19 with water.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A natural evaporation humidifier comprising:

a. a container having a front wall, back wall, bottom, right side wall, and left side wall, arranged to form an interior compartment and a water reservoir, wherein both said right side wall and said left side wall are about 6.0 to 9.0 cm high and both said front wall and said back wall are about 7.0 to 10.0 cm higher than both said right side wall and said left side wall;

b. an inner support portion i. vertically attached to said bottom of said container and a plurality of said inner support portions being arranged in parallel along the length of said container to form a plurality of tunnels and a plurality of evaporation filter housing areas, correspondingly the spaces between said inner support portions, and to support a plurality of evaporation filters;

ii. shaped in a curve along the width of said container;

iii. having a plurality of spacers inside each said tunnel; and iv. having the same height as both said right side wall and said left side wall;

c. said plurality of tunnels extended from said bottom into said interior compartment of said container and arranged in parallel to the width of said container so that heated air enters said plurality of tunnels;

d. said plurality of spacers arranged inside each said tunnel, correspondingly inside space of each said inner support portion, and in parallel to the length of said container to support each said inner support portion and to keep said evaporation filter housing areas in constant size and shape so that each said evaporation filter is firmly placed into each said evaporation filter housing area, wherein one of said spacers is located in the middle of each said tunnel;

e. a plurality of bulges outwardly extruded to a normal direction from the surface of said inner support portion and appointed to receive said evaporation filter, minimizing the contact area between said evaporation filter and said inner support portion, wherein each said bulge is arranged at each end of both sides of each said spacer and there are a plurality of said bulges on each side of each of said filters to vertically support each of said filters;

f. a plurality of auxiliary support portions vertically attached to said bottom of said container and extended to said interior compartment at the end of both sides of said inner support portions, and running parallel with said inner support portions so that said auxiliary support portions are arranged on a curved line that has the same shape as said inner support portions, wherein each of said auxiliary support portions faces to each of said bulges, facing to either said right side wall or said left side wall, of both the leftmost and rightmost one of said inner support portions and there is a space with constant distance between each said auxiliary support portion and each said bulge in order to firmly hold both the first and last one of said evaporation filters at each end of both sides of said inner support;

g. said evaporation filters placed and fixed in said evaporation filter housing areas and in said space between said auxiliary support portions and said bulges, and each said evaporation filter firmly fixed by said bulge and in contact with water in said water reservoir of said container so that each of said evaporation filter becomes wetted; and h. a plurality of support legs, at least four (4) support legs, outwardly and vertically extruded from said bottom of said container to provide the stability and durability of said humidifier to provide a vertical clearance between floor register and said bottom of said container so that the air from the heat air source easily and efficiently traverses into said tunnels through the vertical clearance.

2. A natural evaporation humidifier according to claim 1, wherein said container is slightly sloped outward from said bottom so that the volume of said container is bigger than that of a container in rectangular cuboid shape, thus increasing the capacity of said water reservoir.

3. A natural evaporation humidifier according to claim 1, wherein edges of said front wall, said back wall, said left side wall, and said right side wall of said container are curled outward, preferably in an upside down "U" shape to enhance the rigidity of said container and maintain the shape of said humidifier.

4. A natural evaporation humidifier according to claim 1, wherein both said front wall and said back wall of said container include a plurality of apertures on their upper region above the height of said right and left side walls which is the same as the height of the maximum water level reserved in said container.

5. A natural evaporation humidifier according to claim 4, wherein the upper region of each of said front and back walls has three apertures, one in the middle and the other two on both sides of each said wall, and each of said three apertures is at least 5.5 cm in height and at least 6.5 cm in length, and further wherein the distance between said three apertures on each said wall is about 1.0 to 2.0 cm and said three apertures are located about 1.0 to 2.5 cm inwardly away from the top and both sides of each said wall.

6. A natural evaporation humidifier according to claim 1, both said left side wall and said right side wall of said container are outwardly curved or rounded.

7. A natural evaporation humidifier according to claim 1, wherein the leftmost one of said inner support portions is attached to the point of at least 10 cm away from said left side wall of said container in order to form a water reservoir big enough for users to fill water easily and rapidly without spilling it.

8. A natural evaporation humidifier according to claim 1, wherein each said inner support portion has three spacers inside each said tunnel and said three spacers are located in the middle and two sides of each said tunnel, correspondingly inside space of each said inner support portion.

9. A natural evaporation humidifier according to claim 1, wherein a plurality of aqueduct slots are arranged to said bottom of said container between said inner support portions and each of said front and back walls, in parallel to the length of said container, and are long enough to pass right under all of said evaporation filters placed into said evaporation filter housing areas.

10. A natural evaporation humidifier according to claim 9, wherein the height of said support legs is larger than the depth of said aqueduct slots.

11. A natural evaporation humidifier according to claim 1, wherein each of said auxiliary support portions is "T" shaped and has the upper horizontal line of "T" curved and inwardly directed to said inner support portions and each said auxiliary portions.

12. A natural evaporation humidifier according to claim 1, wherein said auxiliary support portions are lower than said inner support portions and further form a height ranging from 4.5 to 6.0 cm.

13. A natural evaporation humidifier according to claim 1, wherein said bulge forms a rounded shape and the distance between said bulges facing each other is about 1.0 mm to 2.5 mm longer than the thickness of said evaporation filter.

14. A natural evaporation humidifier according to claim 1, wherein the distance between each said auxiliary support portion and each said bulge facing each other is about 1.0 mm to 2.5 mm longer than the thickness of said evaporation filter.

15. A natural evaporation humidifier according to claim 1, wherein a filter positioner vertically extruded from said bottom of said container is arranged in the middle of said evaporation filter housing area between said inner support portions as well as in the middle of a space between said inner support portion and said auxiliary support portions, and aligned with said spacer attached in the middle of said tunnel to securely hold said evaporation filter in place laterally.

16. A natural evaporation humidifier according to claim 15, wherein said filter positioner forms a height ranging from 1.8 cm to 2.5 cm.

17. A natural evaporation humidifier according to claim 1, wherein the length of said evaporation filters is longer than the width of said container and the height of said evaporation filter is about twice higher than the height of said inner support portions and further said evaporation filters are at least 1.5 mm thick.

18. A natural evaporation humidifier according to claim 1, wherein said evaporation filter includes a positioning slot located in the middle of the bottom of said evaporation filter.

19. A natural evaporation humidifier according to claim 1, wherein said evaporation filter in rectangular shape with bottom corner chamfered to facilitate the movement of supplying water.

20. A natural evaporation humidifier according to claim 1, wherein said evaporation filters are composed of thermally compressed non-woven polypropylene or polyethylene plastic materials.

21. A natural evaporation humidifier according to claim 1 wherein said container has an oval shape to provide a large opening for entry of water into said container.

* * * * *